US006047152A

United States Patent [19]

Hattori et al.

[11] Patent Number: 6,047,152

[45] Date of Patent: Apr. 4, 2000

[54] DEVELOPING DEVICE AND IMAGE FORMING APPARATUS

[75] Inventors: Yoshiteru Hattori; Shusaku Tsusaka, both of Nagoya, Japan

[73] Assignee: Brother Kogyo Kabushiki Kaisha, Nagoya, Japan

[21] Appl. No.: 09/028,287

[22] Filed: Feb. 24, 1998

[30] Foreign Application Priority Data

Feb. 28, 1997 [JP] Japan ..... 9-046771

[51] Int. Cl.[7] ..... G03G 15/06

[52] U.S. Cl. ..... 399/256

[58] Field of Search ..... 399/110, 111, 399/119, 120, 252–256, 258, 272, 281

[56] References Cited

U.S. PATENT DOCUMENTS

| | | | |
|---|---|---|---|
| 4,576,466 | 3/1986 | Fukuchi et al. | 399/256 |
| 4,940,014 | 7/1990 | Saijo et al. | 399/256 |
| 5,495,320 | 2/1996 | Araki et al. | 399/256 |
| 5,576,814 | 11/1996 | Nishimura et al. | 399/276 |
| 5,630,198 | 5/1997 | Makino | 399/258 |
| 5,659,859 | 8/1997 | Kikuta et al. | 399/256 |
| 5,832,350 | 11/1998 | Kumasaka et al. | 399/282 |

*Primary Examiner*—William Royer
*Assistant Examiner*—William A. Noe
*Attorney, Agent, or Firm*—Oliff & Berridge, PLC

[57] ABSTRACT

A developing device in an image forming apparatus is provided with: a developing roller opposed to a photosensitive body, on which an electro-static latent image is formed, for developing the electro-static latent image by using toner; a supplying roller for supplying the toner to the developing roller; a wall member prescribing a developing chamber, in which the developing roller and the supplying roller are disposed, and a toner supply port, through which the toner is supplied into the developing chamber; a pair of upper and lower augers disposed in the developing chamber at a vicinity of the toner supply port for carrying and circulating the toner supplied through the toner supply port, and adhering the toner onto the supplying roller; and an auger partition plate disposed between the upper and lower augers for restricting movement of the toner between the upper and lower augers.

10 Claims, 6 Drawing Sheets

DEVELOPING DEVICE AND IMAGE FORMING APPARATUS

BACKGROUND OF THE INVENTION

1. Field of the Invention

The present invention relates to a developing device in an image forming apparatus, which forms an image by means of an electro-photography by using charged toner, and more particularly to a method for supplying the toner to a supplying roller in the developing device.

2. Description of the Related Art

There are various types of developing devices used for an image forming apparatus such as a laser printer or the like. The developing device may be constructed to be integrated into a single unit and may be detachably mounted on the laser printer. Further, the developing device may be provided with a replaceable toner cartridge for retaining toner and may supply the toner from a toner supply port, which is composed of two toner supply holes i.e., a toner supply hole formed at a substantially central position in a width direction of the toner cartridge and a toner supply hole formed on a frame side.

For example, in the toner cartridge, there is an agitator for agitating the toner and then supplying the toner from the toner supply port to a side of a developing chamber. A toner supplying roller is rotatably disposed at the lower portion within the developing chamber, which is blocked by an upper frame and a lower frame. This toner supplying roller charges the toner supplied from the toner supply port with a predetermined polarity, and supplies the charged toner to a developing roller. The developing roller is disposed so as to be in contact with a photosensitive drum, on the surface of which an electro-static latent image is formed by an exposing device for scanning a laser light on the basis of image data. In operation, the developing roller supplies the toner to the electro-static latent image formed on the surface of the photosensitive drum to thereby perform a toner development of the image. Then, the image toner-developed on the surface of the photosensitive drum is transferred onto a paper transported from a paper transporting section, and accordingly the image is formed.

In the above mentioned toner cartridge, it is necessary to prevent the contamination at respective sections of the laser printer, since the toner is leaked out and dispersed when replacing the toner cartridge. Thus, the toner supply port is formed only at one position of a substantially central position in the width direction of the toner cartridge.

Hence, when the toner is supplied from the toner cartridge through the toner supply port to the developing chamber, the toner tend to stay at the central position of the toner supplying roller, in correspondence with the position of the toner supply port. This results in the shortage of the supply of the toner to both ends of the toner supplying roller. In such a case, the toner cannot be uniformly supplied and thus cannot be adhered to the whole toner supplying roller. Consequently, the toner cannot be uniformly supplied to the developing roller and the electro-static latent image on the photosensitive drum. This causes the density irregularity on the image formed on the paper such that the density is dense at the central position of the image and is light at both ends of the image. This results in a problem that the image with an excellent quality cannot be formed.

In order to solve the above mentioned problem, it may be considered to form the toner supply port in the whole width direction of the toner cartridge to thereby supply the toner to the whole toner supplying roller. However, in this case, the toner supplied to both ends of the toner supplying roller tends to stay at both ends of the toner supplying roller. At this time, the toner is used in an order starting from fresh toner, which is easy to be used for the development of the image. Hence, only the toner with poor quality, which is difficult to use for the development of the image, stay at both ends of the toner supplying roller. This results in a problem again that the image with the excellent quality cannot be formed.

The present invention is proposed in view of the above mentioned problems. It is therefore an object of the present invention to provide: a developing device in an image forming apparatus, in which fresh toner from a toner supply port can be uniformly adhered to a whole supplying roller and which can form an image having an excellent quality for a long term; and the image forming apparatus having the developing device.

The above object of the present invention can be achieved by a developing device in an image forming apparatus provided with: a developing roller opposed to a photosensitive body, on which an electro-static latent image is formed, for developing the electro-static latent image by using toner; a supplying roller for supplying the toner to the developing roller; a wall member prescribing a developing chamber, in which the developing roller and the supplying roller are disposed, and a toner supply port, through which the toner is supplied into the developing chamber; a pair of upper and lower auger members disposed in the developing chamber at a vicinity of the toner supply port for carrying and circulating the toner supplied through the toner supply port, and adhering the toner onto the supplying roller; and an auger partition plate disposed between the upper and lower auger members for restricting movements of the toner between the upper and lower auger members.

According to the developing device, the toner is supplied from a toner cartridge through the toner supply port into the developing chamber. Then, the toner in the developing chamber are carried and circulated by the upper and lower auger members, and are adhered onto the supplying roller. At this time, the movements of the toner between the upper and lower auger members are restricted by the auger partition plate. Then, the toner is supplied to the developing roller by the supplying roller. Finally, the electro-static latent image formed on the photosensitive body is developed by using the toner by the developing roller. Accordingly, by the upper and lower auger members and the auger partition plate, the circulation route of the toner is regulated so that the toner is smoothly carried and circulated in the developing chamber, and that the toner is prevented from partially staying in the developing chamber. Consequently, it is possible to almost always adhere the fresh toner uniformly onto the substantially whole area of the supplying roller, so that it is also possible to form the image having the high quality for a long term without the density irregularity by the image forming apparatus.

In one aspect of the developing device of the present invention, the toner supply port is formed at a central position in a lateral direction, which is parallel to rotational axes of the supplying roller and the developing roller, of the developing chamber, the lower auger member carries the toner from the toner supply port toward both end positions in the lateral direction of the developing chamber, the upper auger member carries the toner from the both end positions toward the toner supply port, and the auger partition plate has such a shape that the toner carried by the lower auger member can move through the auger partition plate at both ends thereof to the upper auger member.

According to this one aspect, in the developing chamber, the toner is carried from the toner supply port i.e. the central position toward the both end positions by the lower auger member. Then, the toner is carried from the both end positions toward the toner supply port i.e. the central position by the upper auger member. At this time, the toner carried by the lower auger member can move through the auger partition plate at both ends thereof to the upper auger member. In this manner, the toner is carried and circulated by the lower and upper auger members, while the movements of the toner at positions other than at both end positions are restricted by the auger partition plate. Therefore, it is possible to almost always adhere the fresh toner onto substantially the whole area of the supplying roller.

In this one aspect, the lower auger member may have spiral teeth formed from the central position toward both end positions, and the upper auger member may have spiral teeth formed from both end positions toward the central position. Thus, the toner can be carried and circulated by the spiral teeth of the lower and upper auger members.

In this one aspect also, the auger partition plate may have a portion prescribing a notch at the central position on a far side with respect to the toner supply port. Thus, after the toner is carried and circulated by the upper and lower auger members, while one portion of the toner is returned to the toner cartridge through the toner supply port, another portion of the toner is carried and circulated again through the notch of the auger partition plate at the central position in accordance with the amount of the toner. Therefore, it is possible to carry and circulate the toner efficiently without the sequestration of the toner in the developing chamber.

In this one aspect also, the auger partition plate may be shorter in the lateral direction than the lower and upper auger members. Thus, the toner can move between the lower and upper auger members at both end positions where the auger partition plate is absent.

In another aspect of the developing device of the present invention, the developing device is detachably mounted as one unit on the image forming apparatus.

According to this aspect, the installment, the maintenance and the exchange of the developing device can be easily performed by detaching and attaching the developing device as one unit.

The above object of the present invention can be also achieved by an image forming apparatus provided with: (a) a photosensitive body on which an electro-static latent image is formed, (b) the above described developing device of the present invention, (c) a latent image forming device for forming on the photosensitive body the electro-static latent image corresponding to an image to be recorded, (d) a transferring device for transferring the toner, which is adhered to the photosensitive body in correspondence with the formed electro-static latent image, onto a record paper on which the image is to be recorded, and (e) a fixing device for fixing the toner transferred on the record paper.

According to the image forming apparatus, the electro-static latent image is formed on the photosensitive body by the latent image forming device. Then, the latent image is developed by the aforementioned developing device of the present invention. Then, the developed image of the toner on the photosensitive body is transferred onto the record paper by the transferring device. Finally, the transferred image of the toner on the record paper is fixed by the fixing device. Thus, fresh toner is almost always adhered uniformly onto the substantially the whole area of the supplying roller in the developing device, so that it is possible to form the image having the high quality for a long term without the density irregularity.

In one aspect of the image forming apparatus of the present invention, the image forming apparatus is further provided with a toner cartridge for retaining the toner which has a wall member prescribing a toner supply hole, which fits with the toner supply port of said developing device.

According to this aspect, the toner can be supplied from the toner cartridge through the toner supply port, and one portion of the toner is returned to the toner cartridge through the toner supply port. Thus the supply and circulation of the toner in the developing chamber can be smoothly performed.

The nature, utility, and further features of this invention will be more clearly apparent from the following detailed description with respect to preferred embodiments of the invention when read in conjunction with the accompanying drawings briefly described below.

DETAILED DESCRIPTION OF THE PREFERRED EMBODIMENT

A preferred embodiment for the present invention is explained with reference to the drawings. The embodiment described below is an embodiment in which the present invention is applied to a so-called laser printer for performing a development by means of the non-magnetic material of single component.

(I) Whole Configuration and Operation

At first, the whole configuration of a laser printer according to the embodiment is explained with reference to FIGS. 1 and 2. Incidentally, FIG. 1 is a perspective view showing the appearance of the laser printer according to the embodiment, and FIG. 2 is a vertical longitudinal section view at the central portion thereof.

Figure 1:
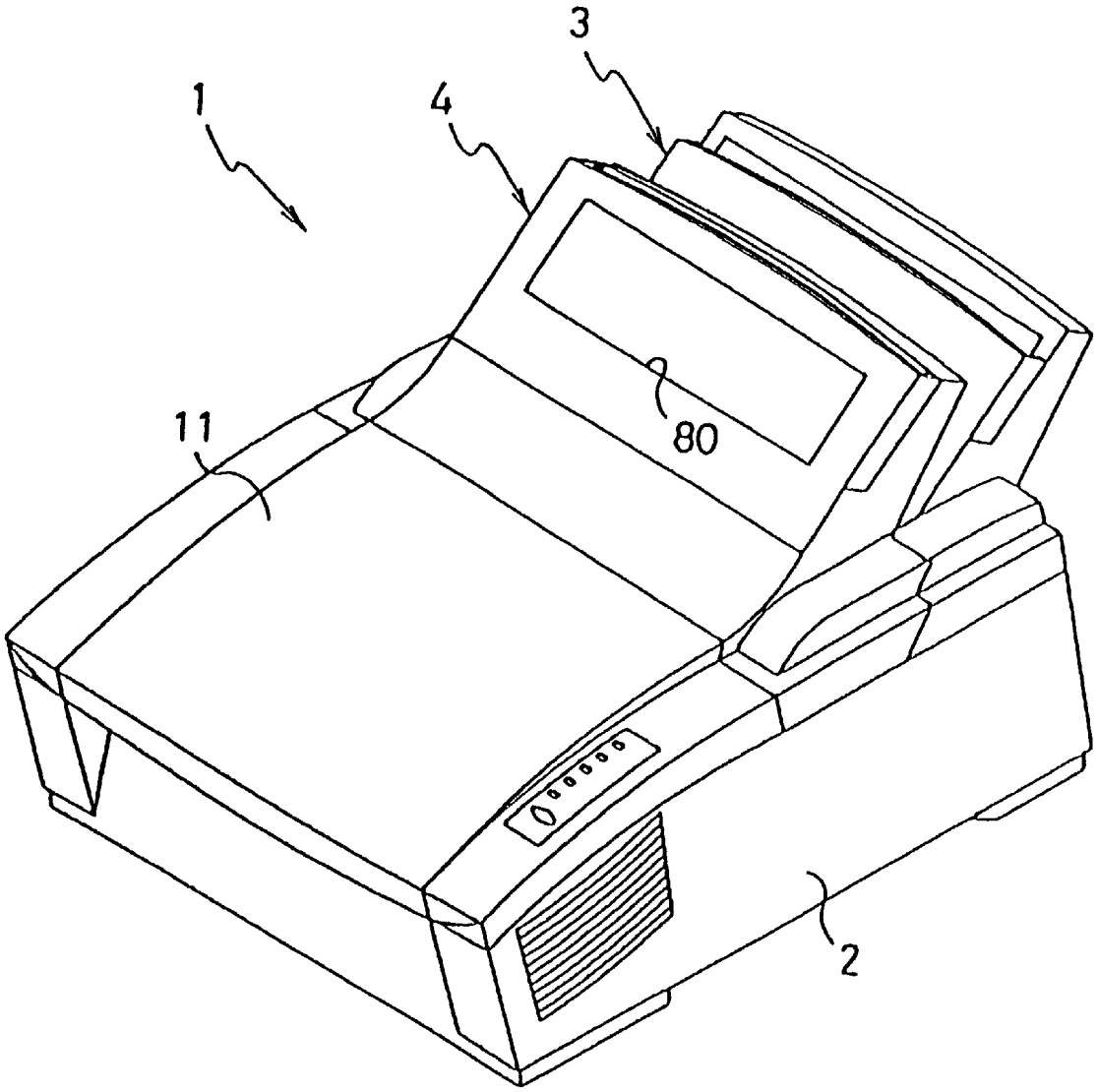
FIG. 1 is a perspective view showing an appearance of a laser printer of an embodiment.
Figure 2:
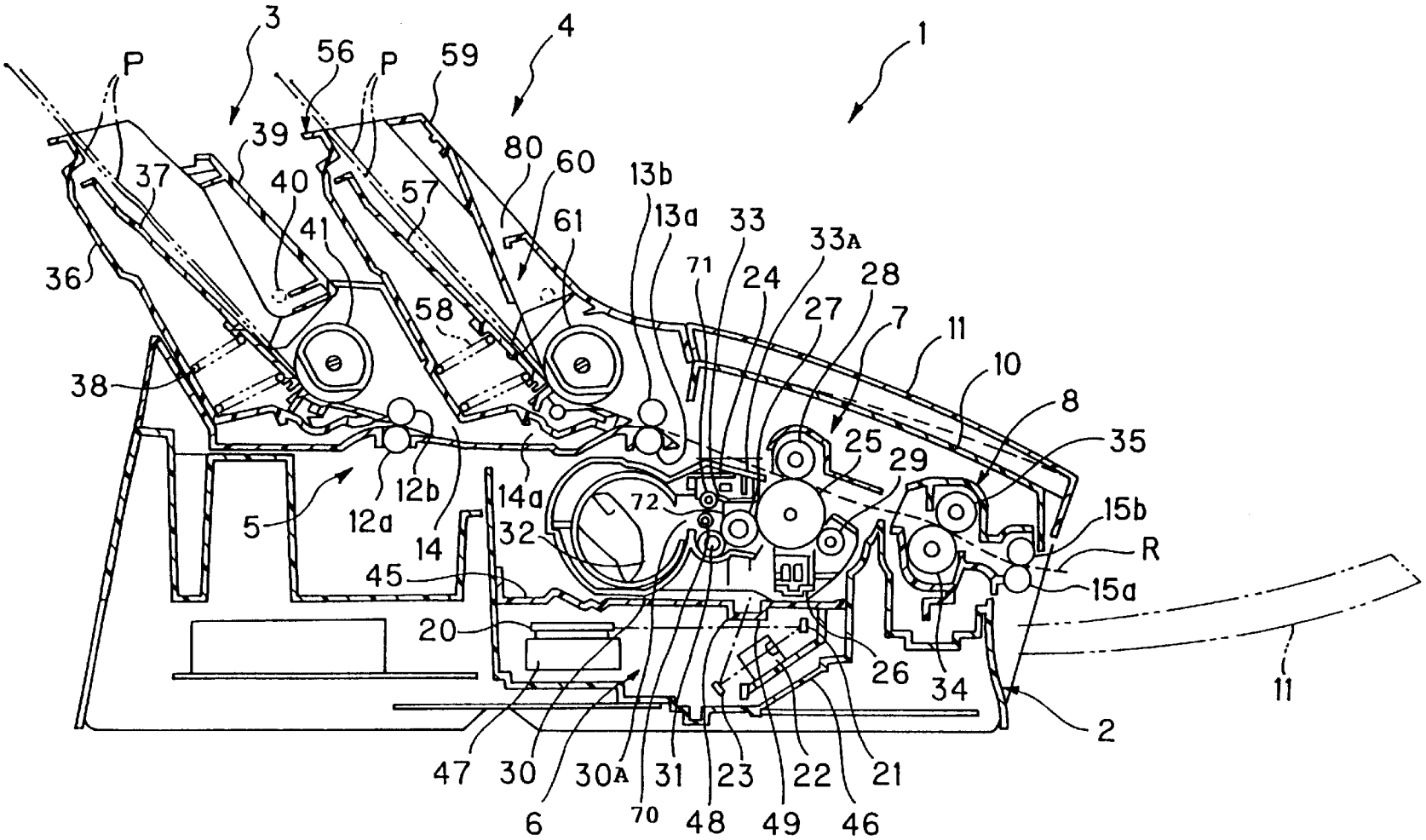
FIG. 2 is a vertical longitudinal section view showing a configuration of the laser printer of the embodiment.

As shown in FIGS. 1 and 2, a laser printer 1 of the embodiment is provided with: a main body case 2; a first paper transporting tray unit 3 and a second paper transporting tray unit 4 which are disposed on the top surface of the rear of the rain body case 2; a paper transporting mechanism 5 disposed within the main body case 2; a scanner unit 6 servicing as one example of an latent image forming device; a process unit 7; a fixing unit 8 servicing as one example of a fixing device; and a driving unit (not shown) accommodated in the left end side on the front surface of the main body case 2 to drive the first paper transporting tray unit 3, the second paper transporting tray unit 4, the paper transporting mechanism 5, the process unit 7, the fixing unit 8.

A top cover 10, by which the inside of the laser printer 1 can be opened, and a paper discharging tray 11 are disposed on the top surface of the front portion of the main body case 2. Among them, the paper discharging tray 11 can be switched from a close position shown by a solid line to an open position shown by a chain line in FIG. 2. Then the paper discharging tray 11 is located at the open position, it services as the tray of receiving and accumulating the recorded papers.

In the above mentioned configuration, the scanner unit 6, the process unit 7 and the fixing unit 8 constitute the print mechanism for actually performing the recording operation.

Among them, the process unit 7 has a cartridge structure in such a way that it contains a photosensitive drum 25, a charger 26, a developing roller 27, a transferring roller 28 servicing as one example of a transferring device, a cleaning roller 29 within a casing 24 and that the process unit 7 can be mounted on and dismounted from a predetermined portion within the main body case 2.

Moreover, the first paper transporting tray unit 3 is fixedly disposed on the top surface in the vicinity of the back end of the main body case 2. The second paper transporting tray unit 4 is detachably disposed on the top surface of the front portion of the first paper transporting tray unit 3 in the main body case 2.

On the other hand, the paper transporting mechanism 5 transports paper P alternatively transported from the first paper transporting tray unit 3 and the second paper transporting tray unit 4 to the process unit 7, and is provided with a pair of transporting rollers 12*a* and 12*b* disposed on the lower end side of the first paper transporting tray unit 3, and a pair of resist rollers 13*a* and 13*b* disposed on the front portion at the lower end of the second paper transporting tray unit 4. Among them, the transporting roller 12*a* is a driving roller, and the transporting roller 12*b* is a driven roller. Further, the resist roller 13*a* is a driving roller, and the resist roller 13*b* is a driven roller.

A paper transporting path 14 from the first paper transporting tray unit 3 to the resist rollers 13*a* and 13*b* includes a bottom side transporting path 14*a* extending along the bottom surface of the second paper transporting tray unit 4. Then, the bottom side transporting path 14*a* becomes in an externally-opened state in the condition that the second paper transporting tray unit 4 is removed from the main body case 2.

Moreover, the paper P transported from the first paper transporting tray unit 3 is transported by the transporting rollers 12*a* and 12*b*, passed on the bottom side transporting path 14*a*, and arrives at the resist rollers 13*a* and 13*b*. After the resist rollers, the paper P is transported to the process unit 7.

On the other hand, the paper P transported from the second paper transporting tray unit 4 arrives at the resist rollers 13*a* and 13*b*. After the resist rollers, the paper P is transported to the process unit 7.

Next, as for the first paper transporting tray unit 3 in detail, the first paper transporting tray unit 3 is provided with: a tray case 36 which can accommodate a plurality of papers P in a backward-raised and inclined state; a paper receiving plate 37 which is disposed at the bottom of the tray case 36 and receives the bottom side of the papers P; a compressed coil spring 38 for forward pushing the paper receiving plate 37; a tray cover 39 which is located opposite to the front side of the paper receiving plate 37 and rotatably disposed in the vicinity of the lower end of the tray case 36 and can be opened and closed by a predetermined angle; a releasing mechanism 40 for releasing the paper receiving plate 37, which functions in conjunction with the opening action of the tray cover 39, backward against the force of the compressed coil spring 38; a paper transporting roller 41.

Moreover, the second paper transporting tray unit 4 is provided with: a tray case 56 which can accommodate a plurality of papers P in a backward-raised and inclined state; a paper receiving plate 57 which is disposed at the bottom of the tray case 56 and receives the bottom side of the papers P; a compressed coil spring 58 for forward pushing the paper receiving plate 57; a tray cover 59 which is located opposite to the front side of the paper receiving plate 57 and rotatably disposed in the vicinity of the lower end of the tray case 56 and can be opened and closed by a predetermined angle; a releasing mechanism 60 for releasing the paper receiving plate 57, which functions in conjunction with the opening action of the tray cover 59, backward against the force of the compressed coil spring 58; a paper transporting roller 61. Incidentally, a manually inserting paper port 80 for transporting the paper P by hand is disposed on the front surface of the second paper transporting tray unit 4.

Next, the process unit 7 is actually explained. The process unit 7 is a unit for performing a toner development for a latent image by supplying the toner to an electro-static latent image formed on the surface of the photosensitive drum 25, on the basis of image data to be recorded by a laser optical system which is disposed in the scanner unit 6 and described later.

That is, the process unit 7 is provided with: the photosensitive drum 25; the transferring roller 28 in contact with the top surface of the photosensitive drum 25; the SCOROTORON type charger 26 disposed below the photosensitive drum 25; the developing device having the developing roller 27, which consists of an elastic rubber roller for example and is disposed upstream from the photosensitive drum 25 in the paper transport direction, and a toner supplying roller 31, which consists of a foamed sponge roller for example; a detachable toner cartridge 30 servicing as one example of a toner retainer disposed further upstream therefrom; the cleaning roller 29 disposed downstream from the photosensitive drum 25 in the paper transport direction.

A pair of upper and lower augers 71 and 70 are rotatably disposed above the toner supplying roller 31 within the developing chamber in the developing device (hereafter, this "developing chamber" implies the portions including the toner supplying roller 31, the developing roller 27, the upper auger 71, the lower auger 70 described later). The lower auger 70 has a function of carrying the toner, which is supplied into the developing chamber through a toner supply port 30*a* (e.g., a hole formed on a substantial centrally located portion of the toner cartridge 30 and a hole formed on the casing 24) from the toner cartridge 30, in both end directions of the toner supplying roller 31. The upper auger 71 has a function of carrying the toner from both ends of the toner supplying roller 31 toward the toner supply port 30*a*. In this way, the toner, which is supplied to the developing chamber side from the toner supply port 30*a* through the lower auger 70 and the upper auger 71, are carried and circulated axially in both directions above the toner supplying roller 31. The toner is supplied while adhered to the toner supplying roller 31 during the carrying and circulating operations. In this embodiment, there is provided an auger partition plate 72 between the upper and lower augers 71 and 70 in a direction parallel to rotation axes of the upper and lower augers 71 and 70, so as to promote the function of transporting the toner together with the upper and lower augers 71 and 70. The structures of the upper and lower augers 71 and 70 and the auger partition plate 72 will be described later in detail.

On the other hand, a blade 33 is fixed by an L-shaped plate fixing member 33A on the bottom surface of the casing 24 above the developing roller 27. This blade 33 charges the toner, which is supplied to the developing roller 27 from the toner supplying roller 31, with a predetermined polarity, and further regulates the layer thickness of a toner layer to a predetermined thickness.

Moreover, an electro-static latent image corresponding to the image data to be recorded by scanning and emitting a laser beam from the scanner unit 6 to the layer charged by the charger 26 is formed on the outer circumference of the photosensitive drum 25. At this time, the toner within the toner cartridge 30 is agitated by an agitator 32 and then exhausted from the toner supply port 30*a*. After that, toner is supported on the outer circumference surface of the developing roller 27 through the toner supplying roller 31. Thus, the thickness of the toner layer is regulated by the blade 33.

Accordingly, the electro-static latent image formed on the photosensitive drum 25 is developed by the adhesion of the toner by the developing roller 27, and is then transferred onto a paper P passed between the transferring roller 28 and the photosensitive drum 25. After that, the toner remaining on the photosensitive drum 25 is once electrically kept on the cleaning roller 29. Then, the toner is electrically returned onto the photosensitive drum 25 at a predetermined timing at which an image is not recorded on the paper P (for example, between a carried paper P and a next paper P, and the like). Furthermore, the toner is supported on the developing roller 27 and collected into the developing chamber.

Next, the scanner unit 6 is explained.

As shown in FIG. 2, the scanner unit 6 comprises a known laser optical system. The scanner unit 6 is a unit for performing a scanning operation of the laser optical system on the basis of the inputted image data to be recorded to thereby form the electro-static latent image on the surface of the photosensitive drum 25.

More concretely, the scanner unit 6 is disposed below the process unit 7. A scanner cover 45 is disposed on the top surface of the scanner unit 6. This scanner cover 45 is fixed such that it covers substantially the entire opening, on the upstream side in the paper transport direction, of a bottom plate 46 of the main body case 2. The scanner unit 6 servicing as one example of an exposing unit is constructed such that a laser emitting section (not shown) such as a semiconductor laser or the like, a scanner motor 47, a polygon mirror 20, a lens 22, reflection mirrors 21 and 23, are disposed on the bottom side of the scanner cover 45. The laser light is passed through a glass plate 49 fitted into an oblong scanner hole 48 formed so as to extend along the rotational axis line of the photosensitive drum 25 by the scanner cover 45, and is emitted onto the outer circumference surface of the photosensitive drum 25. Accordingly, the electro-static latent image is exposure-formed on the outer circumference surface of the photosensitive drum 25 on the basis of the image data. As mentioned above, the toner is supplied through the process unit 7 to the electro-static latent image formed on the photosensitive drum 25 by the laser optical system of the scanner unit 6. Accordingly, the toner development is performed for the electrostatic latent image.

Next, the toner image corresponding to the electro-static latent image formed on the photosensitive drum 25 within the process unit 7 is transferred onto the paper P transported to the process unit 7, and is then transported to the fixing unit 8. This fixing unit 8 fixes the toner, which has been transferred onto the paper P, on the paper P by heating. The fixing unit 8 is provided with: a heating roller 34; a pushing roller 35 pushed against the heating roller 34; and a pair of discharging rollers 15*a* and 15*b*, which are disposed downstream from the heating roller 34 and the pushing roller 35, for discharging the paper P outside the main body case 2.

In FIG. 2, a route R of the paper P between the resist rollers 13*a*, 13*b* and the paper discharging tray 11 disposed downstream in the paper transport direction is indicated by a dotted line.

(II) Detailed Configuration and Function of Process Unit

Figure 3:
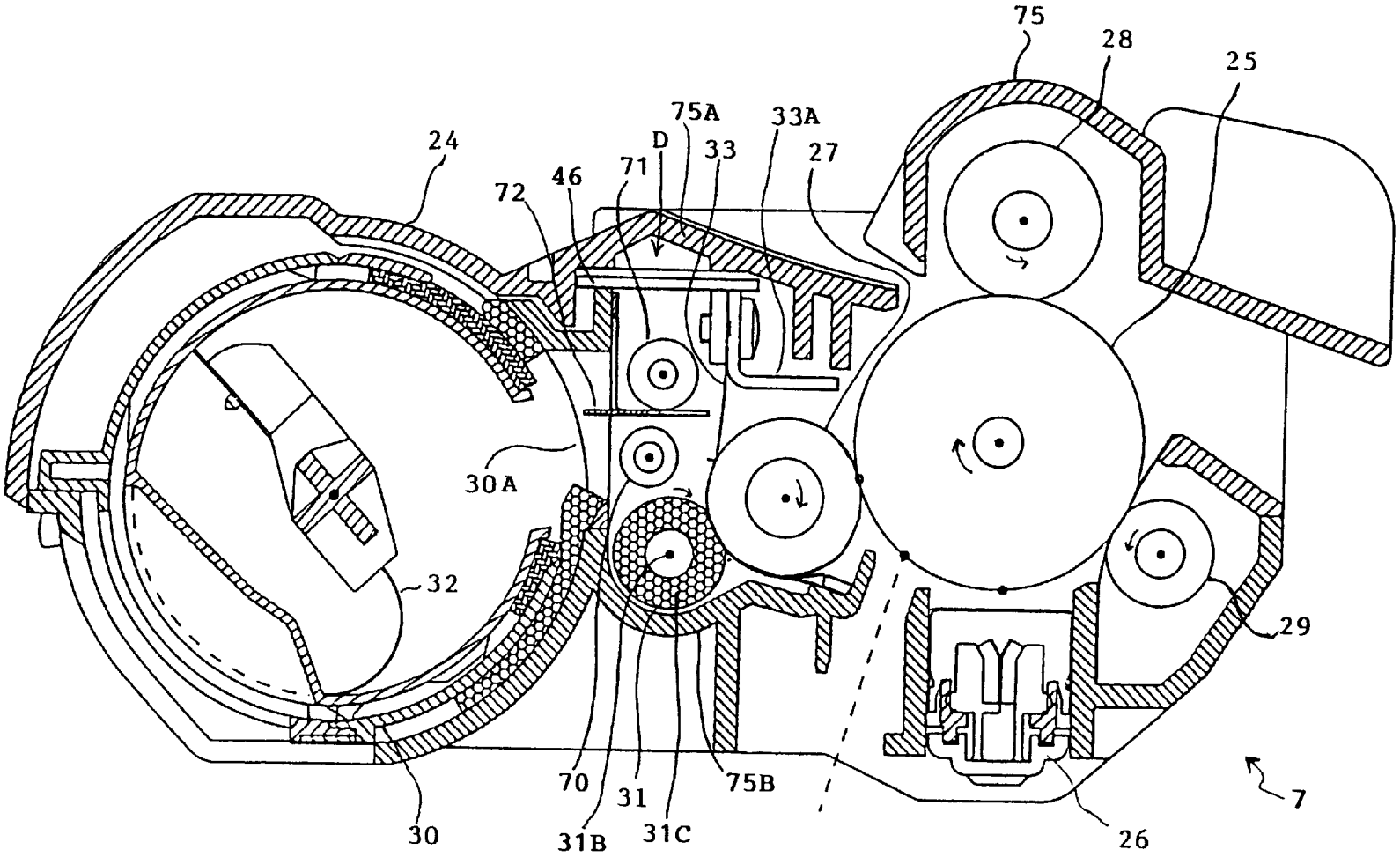
FIG. 3 is a vertical longitudinal section view showing a configuration of a process unit in the laser printer of the embodiment.
Figure 4:
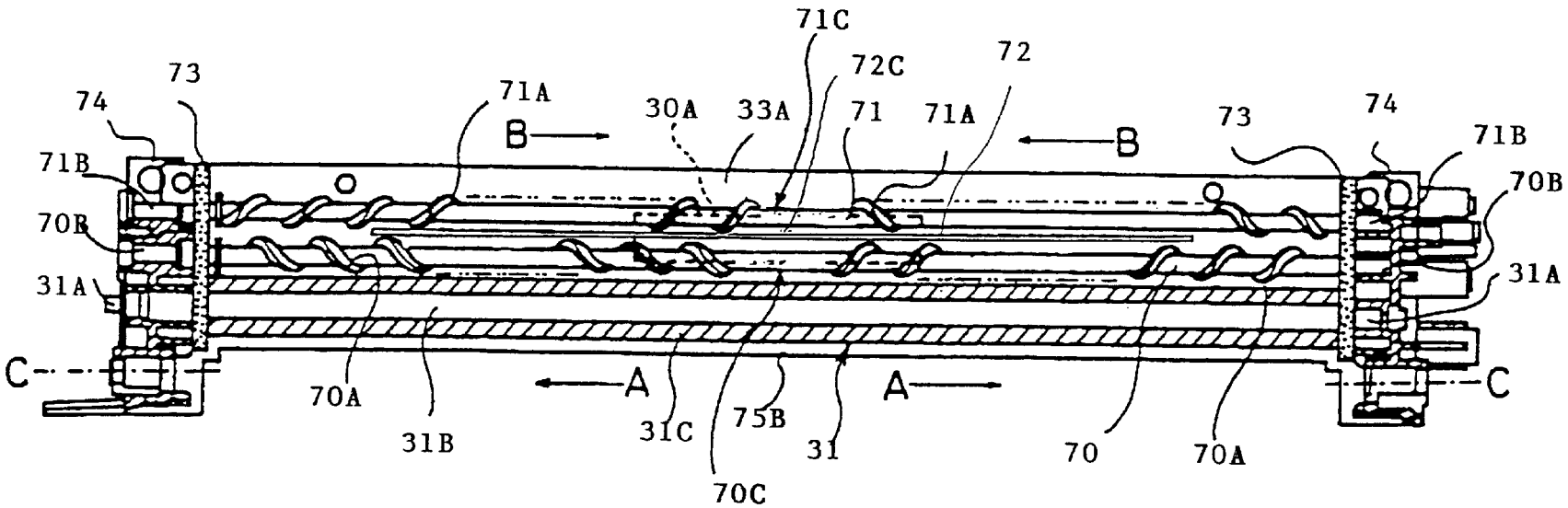
FIG. 4 is a front section view showing an internal portion of the developing chamber of the embodiment.

Next, the detailed configuration of a developing chamber in a process unit 7 is explained with reference to FIGS. 3 and 4. FIG. 3 is a side section view of the process unit 7, and FIG. 4 is a front section view showing the inside of the developing chamber. A developing chamber D is also constituted by the space surrounded by: an upper seal member 46 disposed on a bottom surface of an upper frame 75A of a unit frame 75; a lower frame 75B of the unit frame 75; and a pair of side seal members 73 (refer to FIG. 4) which is disposed at both ends of the developing chamber D and made of a sponge material. A toner supplying roller 31 is constructed such that a roller material 31C made of a sponge material is wrapped around a roller shaft body 31B having roller shafts 31A at both ends thereof. The respective roller shafts 31A are fitted into shaft holes of the side seal member 73, and supported on a pair of support plates 74 which is rotatably mounted on the lower frame 75B outside the side seal member 73 (refer to FIG. 4).

The rotational center C of each support plate 74 is indicated by a dashed line of FIG. 4. Each support plate 74 rotatably supports the developing roller 27, and a pushing spring (not shown) pushes each support plate 74 clockwise in FIG. 3 so that each support plate 74 is rotated clockwise around the rotational center C. Thus, the developing roller 27 abuts to the photosensitive drum 25. In this way, the toner supplying roller 31, the respective upper and lower augers 71 and 70, and the developing roller 27 are integrally supported on each support plate 74. Hence, it is possible to easily adjust the positional relation between the toner supplying roller 31, the respective upper and lower augers 71, 70 and the developing roller 27, as one unit, and it is also possible to simply perform the maintenance and the like as one unit.

As shown in FIG. 4, at the lower auger 70, the central position 70C thereof substantially coincides with a formation position of the toner supply port 30A (i.e., a central position of the toner supply port 30A). Then, there are spiral teeth 70A formed spirally from the central position 70C toward both ends. Further, a roller 70B of the spiral teeth 70A is supported on each support plate 74 similarly to the toner supplying roller 31. Accordingly, when the lower auger 70 is rotated clockwise in FIG. 3, the toner is supplied from the toner supply port 30A and simultaneously carried axially in both directions (arrow A directions) of the developing chamber D in accordance with the spiral direction of the spiral teeth 70A above the toner supplying roller 31. As for the upper auger 71, the central position 71C thereof substantially coincides with the formation position of the toner supply port 30A (i.e., the central position of the toner supply port 30A). Then, there are spiral teeth 71A formed spirally toward the central position 71C from both ends thereof. Further, a roller shaft 71B of the spiral teeth 71A is supported on each support plate 74 similarly to the above mentioned case. Accordingly, when the amount of toner carried into both end directions of the developing chamber D by the lower auger 70 is increased and thereby the toner arrives at the upper auger 71, such toner is simultaneously carried toward the toner supply port 30A (arrow B directions) in accordance with the spiral direction of the spiral teeth 71A.

Moreover, an auger partition plate 72 is disposed between the upper auger 71 and the lower auger 70 in a direction parallel to the rotational axes of the respective augers 71 and 70.

Figure 5:
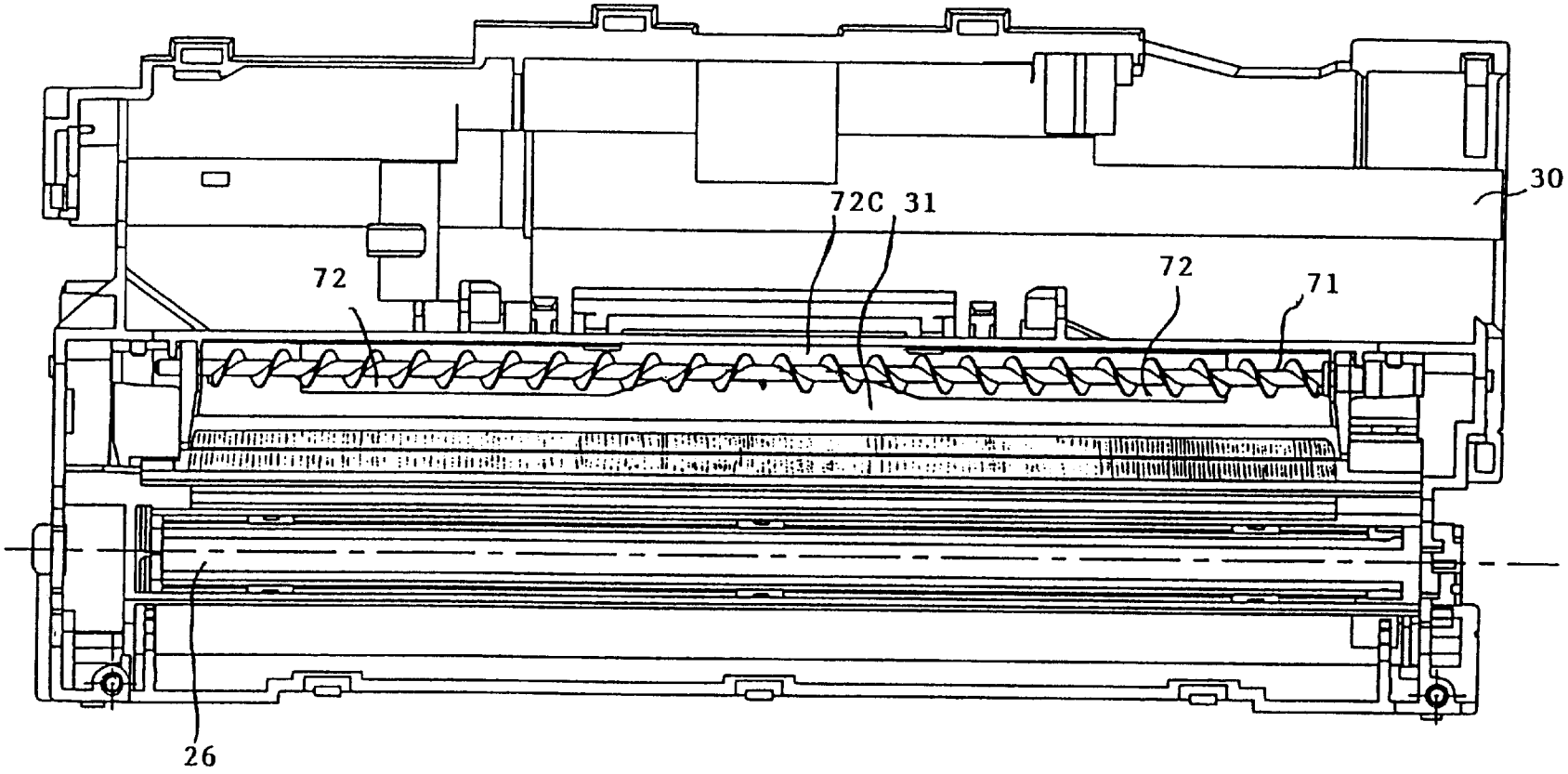
FIG. 5 is a top section view of the process unit of the embodiment.
Figure 6A:
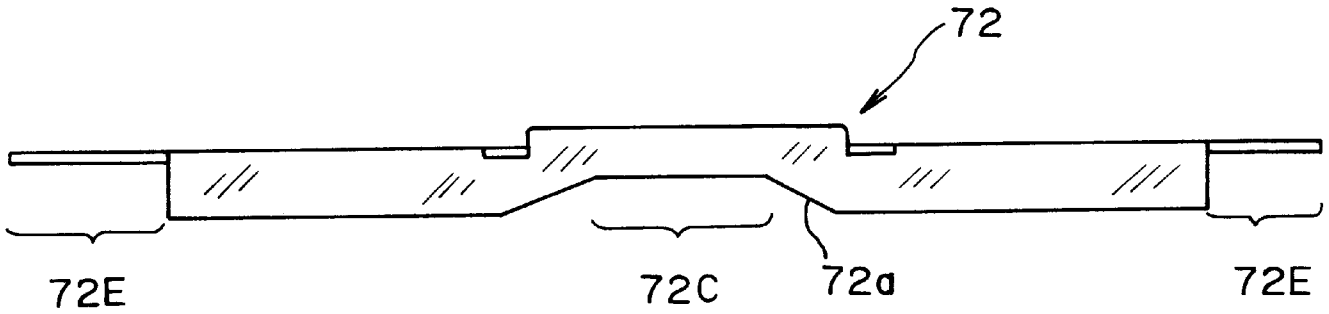
FIG. 6A is a plan view of an auger partition plate in the process unit of the embodiment.
Figure 6B:
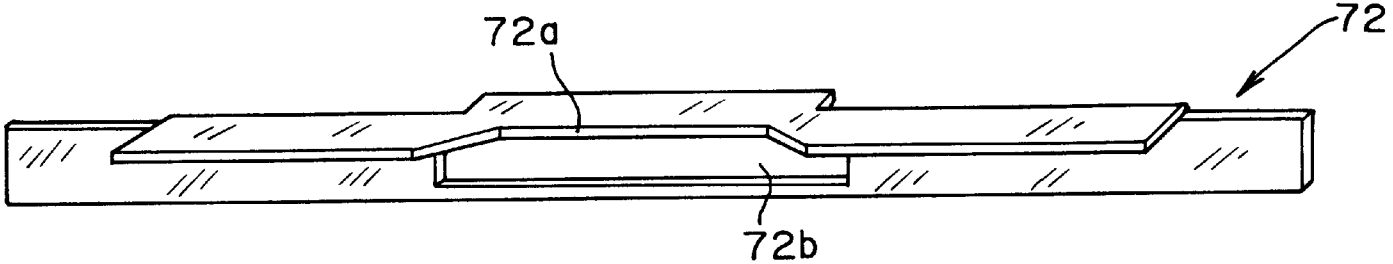
FIG. 6B is a perspective view of an auger partition plate in the process unit of the embodiment.
Figure 6C:
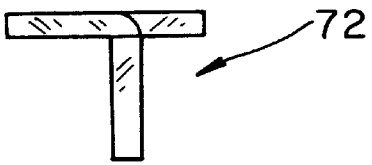
FIG. 6C is a side view of the auger partition plate in the process unit of the embodiment.

As shown in FIG. 5, which is a top section view of the process unit 7, and FIGS. 6A, 6B and 6C, which are a plan view, a perspective view and a side view of the auger partition plate 72 respectively, the auger partition plate 72 has an approximately L-shaped section, and the upper portion thereof is fixed on the upper frame 75A. The length in the longitudinal direction of the upper plate portion of the auger partition plate 72 is shorter than those of the upper and lower augers 71 and 70, which enables the toner to be carried from the lower auger 70 to the upper auger 71 at both ends 72E of the auger partition plate 72. The auger partition plate 72 is constructed such that it has the lateral width so as to cover the augers except the central position 72C and both ends 72E to thereby restrict the movement of the toner between the upper and lower augers 71 and 70. Incidentally, the auger partition plate 72 has such a structure that a notch 72*a* is formed in an upper plate portion thereof at the central position 72C on a far side with respect to the toner supply port 30A, and that a hole 72*b* is formed in a side plate portion thereof at the central position 72C, which is opposed to the toner supply port 30A and through which the toner can be carried (refer to FIGS. 6A and 6B). At the notch 72*a*, the auger partition plate 72 is narrower in lateral width than the upper and lower augers 71 and 70. Hence, the toner in the upper and lower augers 71 and 70 are moved through the notch 72*a* as well as both ends 72E. Therefore, one portion of the toner is carried from the upper auger 71 and returned to the toner supply port 30A into the toner cartridge 30, while another portion of the toner is carried through the notch 72*a* to the lower auger 70 and is subjected to the re-circulation.

As mentioned above, the upper and lower augers 71 and 70 carry and circulate the toner supplied into the developing chamber D from the toner supply port 30A above the toner supplying roller 31, and supply and adhere the toner to the substantially the whole area of the toner supplying roller 31. The auger partition plate 72 prevents the toner from being moved between the upper and lower augers 71 and 70, and further prevents the new toner and the old toner from being mixed with each other during the carrying operation. Hence, the toner can be smoothly agitated and can be uniformly supplied to the substantially whole area of the toner supplying roller 31. In this way, the actions of the upper and lower augers 71 and 70 and the auger partition plate 72 enable the agitation and the circulation without the local stay of the toner. Thus, the flow of the toner is favorably maintained. The fresh toner can be uniformly adhered to the substantially whole area of the toner supplying roller 31. Accordingly, it is possible to uniformly supply the toner to the electro-static latent image on the surface of the developing roller 27 as well as the photosensitive drum 25 to thereby form the image with the excellent quality for a long term.

One portion of the carried toner is returned into the toner cartridge 30 from the toner supply port 30A. This prevents the toner from staying within the developing chamber D for a long time. On the other hand, as mentioned above, the notch 72*a* disposed at the central position 72C on the auger partition plate 72 enables another portion of the toner to be carried through the notch 72*a* to the lower auger 70 and to be subjected to the re-circulation. As a result, even if the amount of the toner carried from the upper auger 71 is vast and thereby they are not sufficiently returned into the toner cartridge 30, the effective carrying and circulating operations can be performed without the local stay of the toner circulation. Furthermore, by changing the shape of the notch 72*a* in the auger partition plate 72, it is possible to correctly adjust the distribution between the toner returned into the toner cartridge 30 and the toner subjected to the re-circulation.

The invention nay be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A developing device in an image forming apparatus, comprising:

a developing roller opposed to a photosensitive body, on which an electro-static latent image is formed, for developing the electro-static latent image by using toner;

a supplying roller for supplying the toner to said developing roller;

a wall member defining a developing chamber, in which said developing roller and said supplying roller are disposed, and a toner supply port, through which the toner is supplied into the developing chamber;

an upper auger and a lower auger disposed in said developing chamber in a vicinity of the toner supply port for carrying and circulating the toner supplied through the toner supply port, and adhering the toner onto said supplying roller; and an auger partition plate disposed between said upper and lower augers for restricting a movement of the toner between said upper and lower augers, wherein said toner supply port is formed at a predetermined position in a lateral direction of the developing chamber, which is parallel to rotational axes of said supplying roller and said developing roller, and wherein one of said upper and lower augers carries the toner from said toner supply port to both end positions in the lateral direction of the developing chamber and the other of said upper and lower augers carries the toner from the both end positions to said toner supply port.

2. A developing device according to claim 1, wherein the predetermined position is a central position in the lateral direction of the developing chamber, said lower auger carries the toner from the toner supply port toward the both end positions, said upper auger carries the toner from the both end positions toward the toner supply port, and said auger partition plate has such a shape that the toner carried by said lower auger can move through said auger partition plate at both ends thereof to said upper auger.

3. A developing device according to claim 2, wherein said lower auger has spiral blades formed thereon, which convey the toner from the central position toward the both end positions, and said upper auger has spiral blades formed thereon, which convey the toner from the both end positions toward the central position.

4. A developing device according to claim 2, wherein said auger partition plate has a portion having a notch at the central position on a far side with respect to the toner supply port.

5. A developing device according to claim 2, wherein said auger partition plate is shorter in the lateral direction than said upper and lower augers.

6. A developing device according to claim 1, wherein said developing device is detachably mounted as one unit on said image forming apparatus.

7. An image forming apparatus, comprising (a) a photosensitive body on which an electro-static latent image is formed, (b) a developing device comprising:

a developing roller opposed to said photosensitive body for developing the electro-static latent image by using toner;

a supplying roller for supplying the toner to said developing roller;

a wall member defining a developing chamber, in which said developing roller and said supplying roller are disposed, and a toner supply port, through which the toner is supplied into the developing chamber:

an upper auger and a lower auger disposed in said developing chamber in a vicinity of the toner supply port for carrying and circulating the toner supplied through the toner supply port, and adhering the toner onto said supplying roller; and an auger partition plate disposed between said upper and lower augers for restricting a movement of the toner between said upper and lower augers, (c) a latent image forming device for forming on said photosensitive body the electro-static latent image corresponding to a predetermined image to be recorded, (d) a transferring device for transferring the toner, which is adhered to said photosensitive body in correspondence with the electro-static latent image formed by said latent image forming device, onto a record paper to record the predetermined image, and (e) a fixing device for fixing the toner transferred on said record paper, wherein said toner supply port is formed at a predetermined position in a lateral direction of the developing chamber, which is parallel to rotational axes of said supplying roller and said developing roller, and wherein one of said upper and lower augers carries the toner from said toner supply port to both end positions in the lateral direction of the developing chamber and the other of said upper and lower augers carries the toner from the both end positions to said toner supply port.

8. An image forming apparatus according to claim 7, further comprising a toner cartridge for retaining the toner which has a frame defining a toner supply hole, which fits with the toner supply port of said developing device.

9. An image forming apparatus according to claim 7, wherein the predetermined position is a central position in the lateral direction of the developing chamber, said lower auger carries the toner from the toner supply port toward the both end positions, said upper auger carries the toner from the both end positions toward the toner supply port, and said auger partition plate has such a shape that the toner carried by said lower auger can move through said auger partition plate at both ends thereof to the upper auger.

10. A developing device according to claim 2, wherein said auger partition plate has such a structure that a hole is formed in a side plate portion thereof at the central position, which is opposed to the toner supply port and through which the toner can be carried.

* * * * *